US009421413B2

(12) United States Patent
Staten et al.

(10) Patent No.: US 9,421,413 B2
(45) Date of Patent: Aug. 23, 2016

(54) RESISTIVE PULL EXERCISE DEVICE

(71) Applicant: Rogers Athletic Company, Clare, MI (US)

(72) Inventors: Kenneth Staten, Clare, MI (US); Michael Gittleson, Ann Arbor, MI (US); Kyle R. Camp, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 359 days.

(21) Appl. No.: 13/872,524

(22) Filed: Apr. 29, 2013

(65) Prior Publication Data

US 2013/0296146 A1 Nov. 7, 2013

Related U.S. Application Data

(60) Provisional application No. 61/640,911, filed on May 1, 2012.

(51) Int. Cl.

| | |
|---|---|
| ***A63B 21/018*** | (2006.01) |
| ***A63B 21/04*** | (2006.01) |
| ***A63B 21/00*** | (2006.01) |
| ***A63B 23/12*** | (2006.01) |
| ***A63B 23/035*** | (2006.01) |

(52) U.S. Cl.

CPC ..... *A63B 21/018* (2013.01); *A63B 21/00069* (2013.01); *A63B 21/00185* (2013.01); *A63B 21/0442* (2013.01); *A63B 21/154* (2013.01); *A63B 21/4035* (2015.10); *A63B 21/4043* (2015.10); *A63B 23/03541* (2013.01); *A63B 23/1209* (2013.01); *A63B 23/1218* (2013.01); *A63B 23/1245* (2013.01); *A63B 2225/093* (2013.01)

(58) Field of Classification Search

CPC .. A63B 21/153; A63B 21/154; A63B 21/015; A63B 21/157; A63B 21/1484; A63B 23/03541; A63B 21/018; A63B 21/0442; A63B 21/1469; A63B 2225/093; A63B 23/1209; A63B 23/1218; A63B 23/1245; A63B 21/00069; A63B 21/00185; A63B 69/0048; A62B 1/14; A62B 35/04; A62B 1/10; A62B 35/0068; A62B 35/0093; A62B 1/20; A62B 1/08; A62B 1/16; A62B 35/0025; A62B 35/0075; B60T 11/046; B60T 13/746; B60T 7/122; B60T 7/104

USPC ..... 482/92, 114–121, 127–128, 148

See application file for complete search history.

(56) References Cited

U.S. PATENT DOCUMENTS

| | | | | | |
|---|---|---|---|---|---|
| 3,472,510 | A | * | 10/1969 | Holkesvick | 482/120 |
| 3,506,262 | A | * | 4/1970 | Wade | 482/120 |
| 3,550,449 | A | * | 12/1970 | Henson | 482/120 |
| 3,674,261 | A | * | 7/1972 | Krug | 482/120 |
| 3,885,789 | A | * | 5/1975 | Deluty et al. | 482/120 |
| 4,010,948 | A | * | 3/1977 | Deluty | 482/120 |
| 4,040,627 | A | * | 8/1977 | Useldinger | 482/120 |
| 4,114,875 | A | * | 9/1978 | Deluty | 482/120 |
| 4,359,139 | A | * | 11/1982 | Bloder | A62B 1/10 182/234 |

(Continued)

*Primary Examiner* — Stephen Crow
*Assistant Examiner* — Andrew S Lo
(74) *Attorney, Agent, or Firm* — Carlson, Gaskey & Olds, P.C.

(57) ABSTRACT

An example resistive pull exercise device includes a support housing having a first passageway and an opposing, second passageway, and a tension member to selectively impart a resistive force to a length of material spanning the first and second passageways.

22 Claims, 9 Drawing Sheets

(56) References Cited

U.S. PATENT DOCUMENTS

| | | | | | |
|---|---|---|---|---|---|
| 4,540,172 | A * | 9/1985 | Evans | 482/120 | |
| 5,076,574 | A | 12/1991 | Johnson, Jr. | | |
| 5,352,172 | A * | 10/1994 | Suzaki | 482/120 | |
| 5,496,234 | A | 3/1996 | Sussich | | |
| 5,795,274 | A * | 8/1998 | Kasbohm | 482/115 | |
| 5,803,209 | A * | 9/1998 | Suzaki | 188/65.2 | |
| 6,029,777 | A * | 2/2000 | Rogelja | A62B 1/14 | 182/192 |
| 6,102,837 | A * | 8/2000 | Hubbard | 482/120 | |
| 6,315,701 | B1 * | 11/2001 | Shifferaw | 482/114 | |
| 7,018,323 | B1 | 3/2006 | Reynolds et al. | | |
| 7,060,003 | B1 | 6/2006 | Reynolds et al. | | |
| 7,291,099 | B1 * | 11/2007 | Marczewski | 482/114 | |
| 7,303,506 | B1 | 12/2007 | Reynolds et al. | | |
| 7,387,593 | B2 | 6/2008 | Ryan et al. | | |
| 8,025,608 | B2 | 9/2011 | Popescu | | |
| 8,348,016 | B2 * | 1/2013 | Lewis | A62B 1/14 | 182/192 |
| 2005/0148437 | A1 * | 7/2005 | Ryan et al. | 482/37 | |
| 2007/0151805 | A1 * | 7/2007 | Betcher | A62B 35/0093 | 182/239 |
| 2008/0318740 | A1 * | 12/2008 | Ross et al. | 482/92 | |
| 2009/0137370 | A1 | 5/2009 | Kushnir | | |
| 2010/0137112 | A1 * | 6/2010 | Harker | 482/92 | |
| 2010/0298104 | A1 * | 11/2010 | Turner | 482/93 | |
| 2011/0269604 | A1 * | 11/2011 | Tseng | 482/121 | |
| 2011/0287910 | A1 * | 11/2011 | Ladd et al. | 482/127 | |
| 2014/0299411 | A1 * | 10/2014 | Aldred | A62B 1/10 | 182/5 |

* cited by examiner

RESISTIVE PULL EXERCISE DEVICE

CROSS-REFERENCE TO RELATED APPLICATIONS

This application claims priority to U.S. Provisional Application No. 61/640,911, which was filed on 1 May 2012 and is incorporated herein by reference.

BACKGROUND

This disclosure relates to exercise equipment and, more particularly, to a resistive pull assembly for resisting movement of a rope, belt, or some other length of material.

Individuals perform various exercises for the purpose of developing and training their bodies. Exercises can be performed using free weights, such as barbells, or with machines providing resistance. Many individuals prefer machines that provide a natural motion while utilizing body leverage in performing the exercise. This facilitates isolation of particular parts of the individual's body. Adjusting the resistance of such machines is often complicated.

SUMMARY

An example resistive pull exercise device includes a support housing having a first passageway and an opposing, second passageway, and a tension member to selectively impart a resistive force to a length of material spanning the first and second passageways.

Another example resistive pull exercise device includes a first plate, a second plate spaced from the first plate to define an interior space therebetween, a plurality of first rollers establishing a perimeter of a first passageway from outside the interior space to the interior space, a plurality of second rollers establishing a perimeter of a second passageway from outside the interior space to the interior space, the first and second passageways positioned along an axis, a length of material having a portion extending through the interior space from the first passageway to the second passageway, and a tension member adjustably mounted to at least one of the first and second plate and contacting a portion of the length of material to move the portion away from the axis.

An example method of resisting movement of a length of material in a resistive pull device, where the length of material extends between a first and second passageway in a support housing, includes increasing a curvature of the length of material to increase the resistive force, and decreasing the curvature of the length of material to decrease the resistive force.

BRIEF DESCRIPTION OF THE DRAWINGS

The various features and advantages of this disclosure will become apparent to those skilled in the art from the following detailed description of an example embodiment. The drawings that accompany the detailed description can be briefly described as follows.

DETAILED DESCRIPTION

Figure 1:
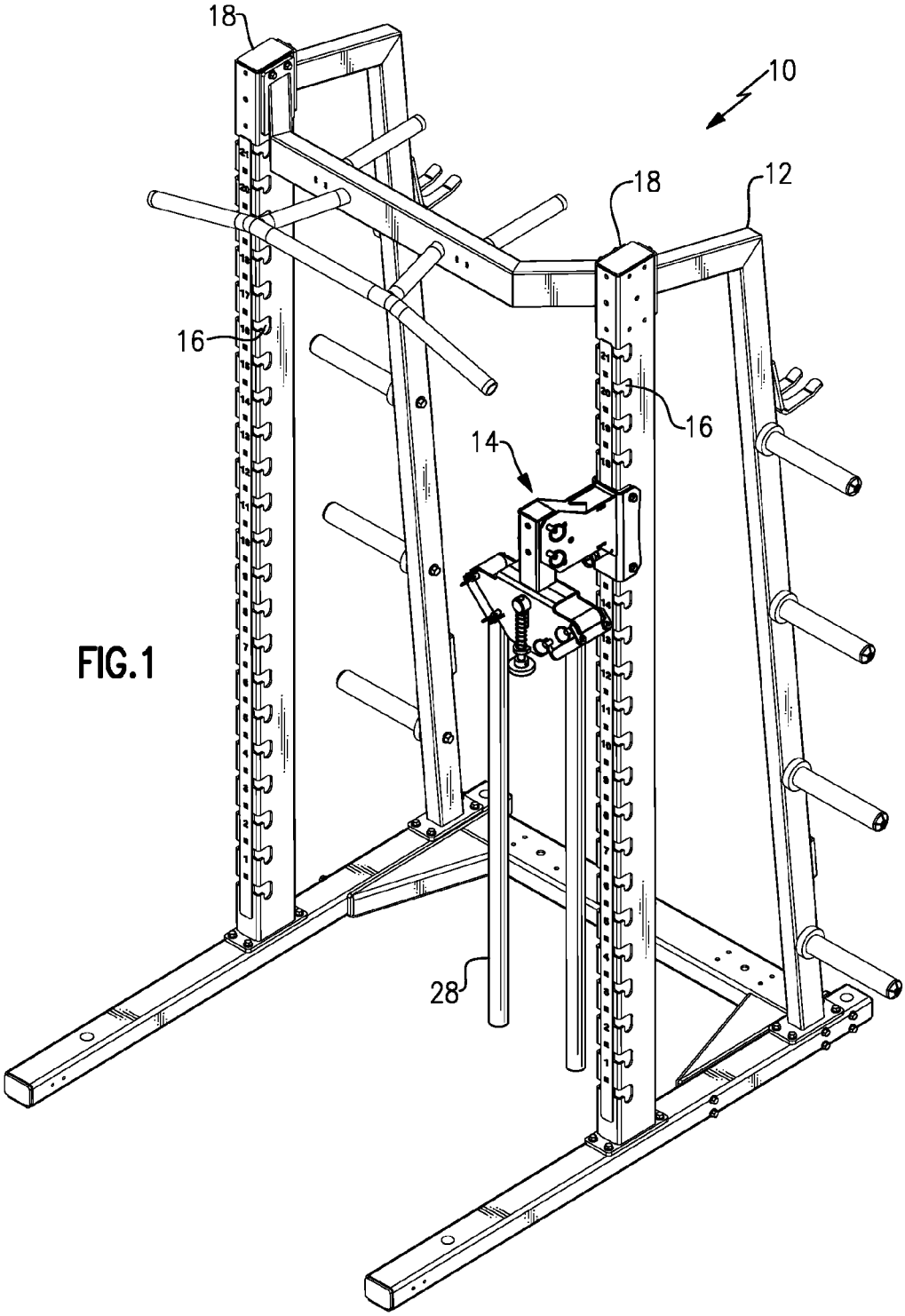
FIG. 1 is a general perspective view of an example rope pull assembly mounted to a frame rack.

Referring to FIG. 1, an example exercise system 10 includes a frame rack 12 and rope pull assembly 14. The frame rack 12 is a type of support for the rope pull assembly 14. It should be understood that although a particular frame rack is illustrated in the example embodiment, other types of supports frame racks could be used to support the example rope pull assembly 14. The rope pull assembly 14 could also be a wall-mounted unit supported by a wall rather than the frame rack 12. The rope pull assembly 14 is an example resistive pull exercise device that is used for pulling exercises.

The frame rack 12 includes multiple openings 16 along an upright frame member 18, which receives the rope pull assembly 14. The rope pull assembly 14 is received into selected openings 16 so that the rope pull assembly 14 may be located at various positions along the upright frame member 18. Each opening 16 is separated from the next by approximately four inches to provide significant incremental adjustment, however, any separation will be usable with the present invention.

Figure 2:
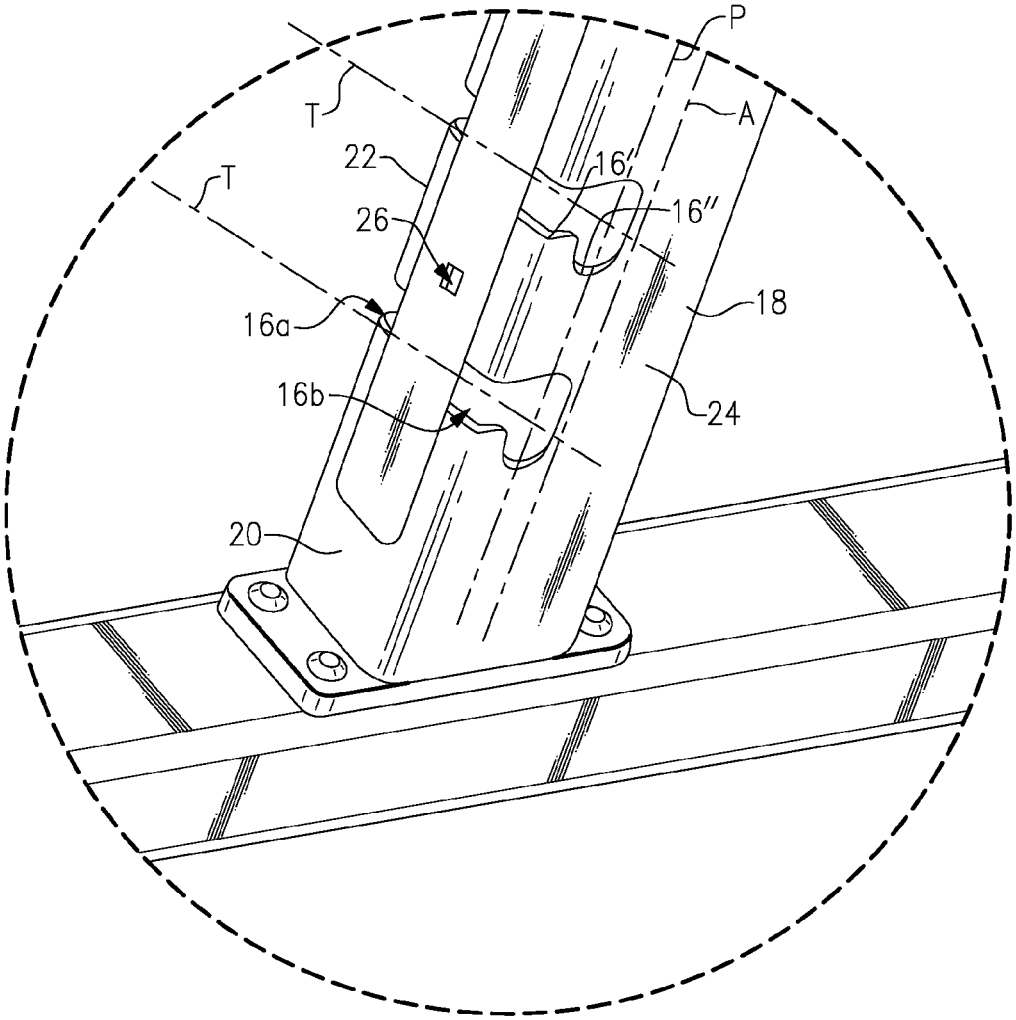
FIG. 2 is an expanded view of a weightlifting system upright frame member of the frame rack of FIG. 1.

Referring to FIG. 2, each upright frame member 18 defines a longitudinal axis A extending vertically relative to the ground. The example upright frame member 18 is generally rectilinear in shape and is manufactured of tubing that is rectangular in cross-section. The upright frame member 18 has a front face 20 and a first and second side face 22, 24. The upright frame member 18 includes a multiple of opposed pairs of openings 16*a*, 16*b* along the longitudinal axis A. Each of the opposed pairs of openings 16*a*, 16*b* includes a first opening portion 16' and a second opening portion 16".

Each opening 16*a*, 16*b* is generally L-shaped and spans the intersection of the front face 20 and one of the side faces 22, 24. In this non-limiting embodiment, the first opening 16*a* spans the front face 20 and the side face 22, and the second opening 16*b* spans the front face 20 and the side face 24. In other words, each opening 16 cuts through the corner of the upright frame member 18.

Figure 3:
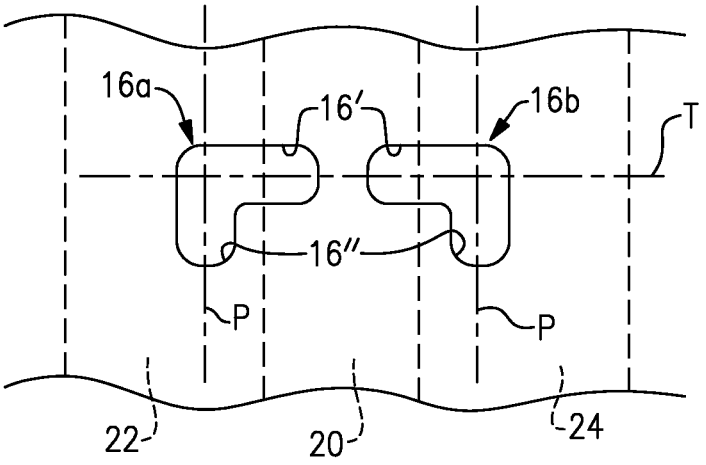
FIG. 3 is a schematic view of an opening in a weightlifting system upright frame member illustrated in FIG. 2.
Figure 7:
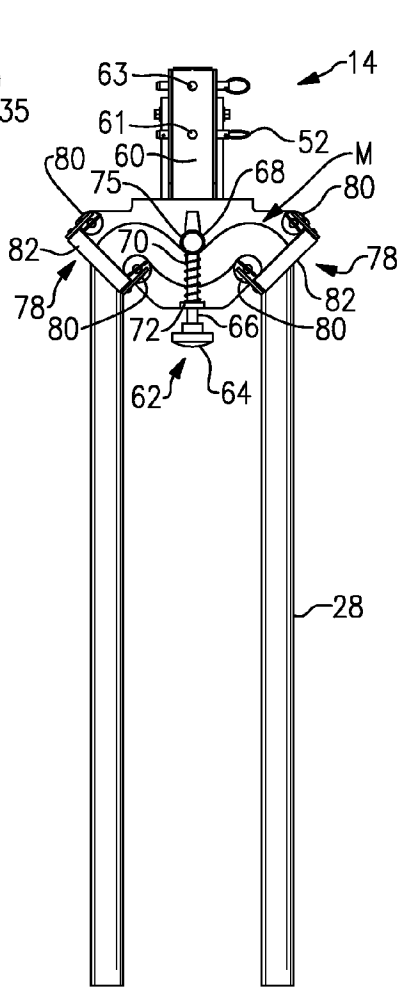
FIG. 7 is a front view of the rope pull assembly of FIG. 1 with the first housing member removed.
Figure 6:
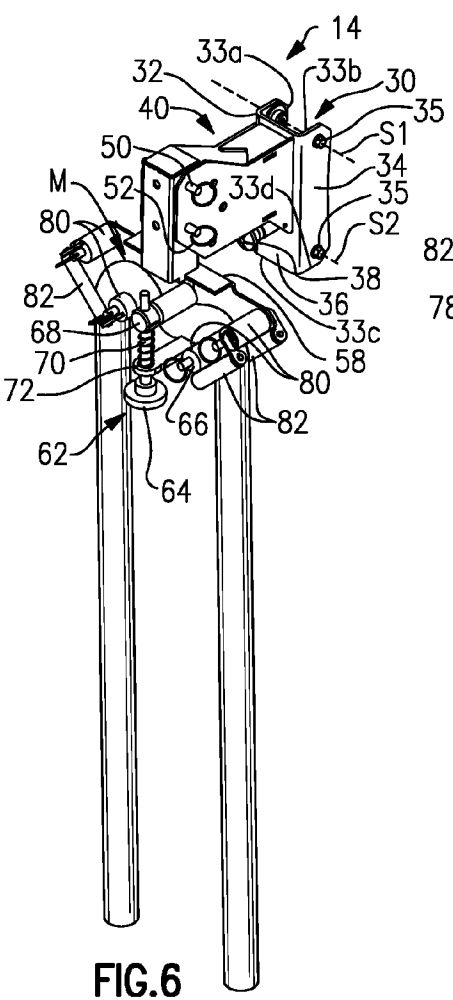
FIG. 6 is a general perspective view of the rope pull assembly of FIG. 1 with a first housing member removed.
Figure 5:
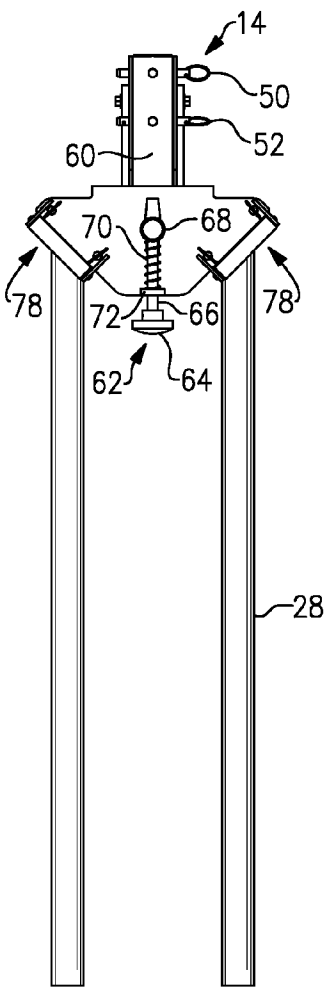
FIG. 5 is a front view of the rope pull assembly of FIG. 1.
Figure 4:
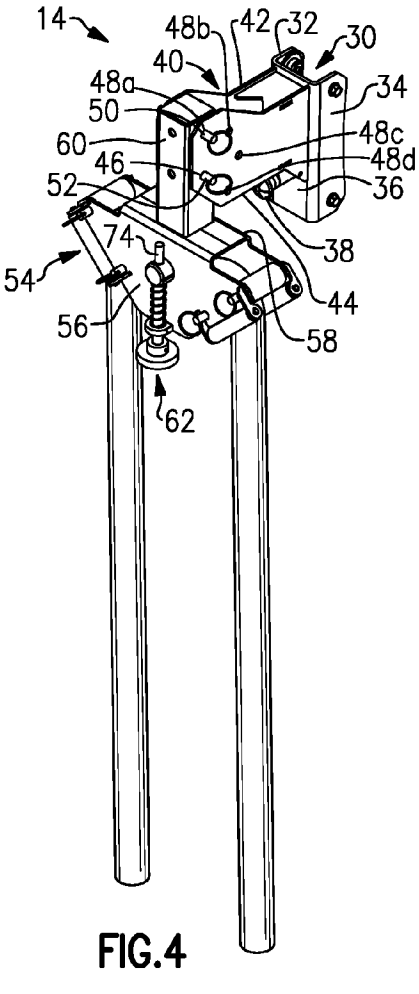
FIG. 4 is a general perspective view of the rope pull assembly of FIG. 1.

The first opening portion 16' in the front face 20 generally transverse to the longitudinal axis A along a transverse opening axis T and a second opening portion 16" through the respective side face 22, 24 generally parallel to the longitudinal axis A along a parallel opening axis P. In this non-limiting embodiment, the first opening portion 16' of the opening 16*a* extends through the front face 20 generally transverse to the longitudinal axis A along the transverse opening axis T. A second first opening portion 16" of the opening 16*a* extends through the first side face 22 generally parallel to the longitudinal axis A along the parallel axis P. The second opening 16*b* defines the first second opening portion 16' through the front face 20 generally transverse to the longitudinal axis A along the transverse opening axis T. A second second opening portion 16" of the second opening 16*b* extends through the second side face 24 generally parallel to the longitudinal axis A along the parallel axis P. That is, the portions 16' of the openings 16*a* and 16*b* are generally perpendicular and portions 16' are generally parallel if laid flat (FIG. 3). Each example opening 16*a*, 16*b* includes relatively large corner radiuses.

The openings 16 are arranged in horizontally opposed pairs of openings 16*a*, 16*b* perpendicular to the longitudinal axis A. That is, each pair of openings 16 includes a first opening 16*a* located through the front face 20 and the first side face 22 and a second opening 16*b* located through the front face 20 and the second side face 24 such that the openings 16*a*, 16*b* are aligned when viewed from one of the side faces 22, 24.

A lock opening 26 is located through the front face 20 between each vertically separated pair of openings 16*a*, 16*b*. Each lock opening 26 is displaced parallel to the longitudinal axis A and is generally square in shape. It should be understood that other shapes will also be readily usable with the example embodiment. The example lock opening 26 is longitudinally staggered above each pair of openings 16*a*, 16*b*.

Referring to FIGS. 4-7, the rope pull assembly 14 includes a main support 30 having a first support plate 32 opposed to and generally parallel with a second support plate 34. The support plates 32, 36 extend generally perpendicularly from a central support plate 36 to generally form a U-shape. The main support 30 may be manufactured from a single, integral U-channel member.

An attachment support 40 includes a first attachment plate 42 opposed to and generally parallel with a second attachment plate 44. The first attachment plate 42 and the second attachment plate 44 extend from the main support 30 to form a U-shaped opening for accepting a support housing 54. The first attachment plate 42 and the second attachment plate 44 include corresponding pivot openings 46 for pivotably attaching a post 60 that extends from the support housing 54 to the attachment support 40. A removable pivot pin 52 extends through pivot openings 46 on the first and second attachment plates 42, 44 and through two of the post pivot openings 61 on the post 60 to pivotably connect the support housing 54 to the attachment support 40. The support housing 54 is locked in a fixed rotational position relative to the attachment support 40 by a support pin 50 that extends through a pair of adjustment openings 48*a*, 48*b*, 48*c*, 48*d* located on the first and second attachment plates 42, 44 and two of the post pivot openings 63 on the post 60.

The support housing 54 includes a first housing member 56 and a second housing member 58, which together form halves of the support housing 54. The support housing 54 includes a tension member 62, or tension member, for controlling the force required to pull a rope 28 or belt through the support housing 54 by a user. The rope 28 or belt may be a continuous loop, or may terminate at distinct ends as shown.

The example tension member 62 includes a handle 64 fixedly attached to a rotatable threaded shaft 66 that extends from a tension member 68 to a guide member 72. The guide member 72 extends from the second housing member 58 to support the rotatable threaded shaft 66. The threads on the rotatable threaded shaft 66 engage the tension member 68 but moves freely relative to the guide member 72.

A first end of a spring 70 engages the tension member 68 and a second end of the spring 70 engages the guide member 72 to provide a separation force between the tension member 68 and the guide member 72. The spring 70 provides a biasing force that moves the tension member 68 away from contact with the rope 28. Although the example tension 62 includes a single threaded rotatable shaft 66, a second threaded rotatable shaft could be located on the opposite side of the support housing 54 or a clamp mechanism could be used.

A length of material M of the rope 28 extends through the support housing 54 in a serpentine or curved manner through a pair of rope passageways 78 on opposing sides of the support housing 54 and between the tension member 68 and the guide member 72. The pair of rope passageways 78 are positioned along an axis. The length of material M is considered the portion of the rope 28 within an interior of the support housing 54.

Because the length of material M is curved or serpentine, the length of material M may be considered to be displaced relative to the axis. The tension member 68 moves in a direction that is generally perpendicular to the axis in this example to selectively increase or decrease the curvature, which increase or decreases the resistive force.

Each of the pair of rope passageways 78 includes a first pair of rollers 80 that are generally transverse to a second pair of rollers 82. The first and second pair of rollers 80, 82 decrease the chance of the rope 28 snagging or fraying while passing through the support housing 54. The tension member 68 in this example does not roll relative to the first or second housing member 56, 58, but is fixed in order to provide increased resistance for pulling the rope 28 through the support housing 54. The tension member 68 may roll in some examples and still provide increased resistance.

The tension member 68 is generally positioned to contact a side of the rope 28 to deflect the rope 28 into the serpentine orientation as it passes through the support housing 54 to increase the force necessary to pass the rope through the support housing 54. The example tension member 68 contacts the length of material at a position that is approximately equidistant from the pair of rope passageways 78.

The amount of force needed to pull the rope 28 through the support housing 54 can be varied by repositioning the tension member 68. As the handle 64 on the tension member 62 is rotated in a first direction, the tension member 68 moves in a first direction through grooves 74, 75 located on the first and second housing members 56, 58, respectively, to increase the force required to pull the rope 28 through the support housing 54 by increasing the friction and deflection experienced by the rope 28. As the handle 64 is rotated in a second direction, the tension member 68 moves in a second direction opposite the first direction through grooves 74, 75 located on the first and second housing members 56, 58, respectively, to decrease the force required to pull the rope 28 through the support housing 54 by decreasing the friction and deflection experienced by the rope 28.

The first and second directions extend along an axis that is transverse, and perpendicular in this example, to and axis defined by the passageways 78.

The force needed to pull the rope 28 through the support housing 54 will vary depending on the dimensions and type of the rope 28 and the position of the tension member 68. For example, stiffer ropes 28 with a large diameter will require more force to pull through the support housing 54 than more flexible ropes when the tension member 68 is in the same position. Forces for belts and other structures may similarly vary.

A first, a second, a third, and a fourth stud 33*a*-33*d* (FIG. 6) extend from an inner surface of the first and second support plates 32, 34 to engage the openings 16. The first stud 33*a* extends from the first support plate 32 and is directly opposed to the second stud 33*b*, which extends from an inner surface of the second support plate 34. The third stud 33*c* extends from the first support plate 32 and is directly opposed to the fourth stud 33*d*, which extends from an inner surface of the second support plate 34. The first and second studs 33*a*, 33*b* are located on a common axis S1 and the third and fourth studs 33*c*, 33*d* are located along a common axis S2. The studs 33*a*-33*d* are relatively significant solid members. The studs 33*a*-33*d* mount through the first and second support plates 32, 34 with fasteners 35 or the like. A safety pin 38 extends through the central support plate 36 to secure the rope pull assembly 14 to the upright frame member 18 by extending through the lock opening 26.

FIG. 4-8 show the support housing 54 secured in a vertical position generally parallel to the upright frame member 18. The support housing 54 is secured in the vertical position by pivoting the support housing 54 about the pivot pin 52, which extends through pivot openings 46 on the first and second attachment plates 42, 44 and the post pivot openings 61 on the post 60, until post pivot openings 63 on the post 60 align with the pair of adjustment openings 48*a* on the attachment support 40 to allow the support pin 50 to secure the support housing 54 in the vertical position. Each side of the post 60 includes a pair of the post pivot openings 61, 63.

Figures 8, 9, 10, 11:
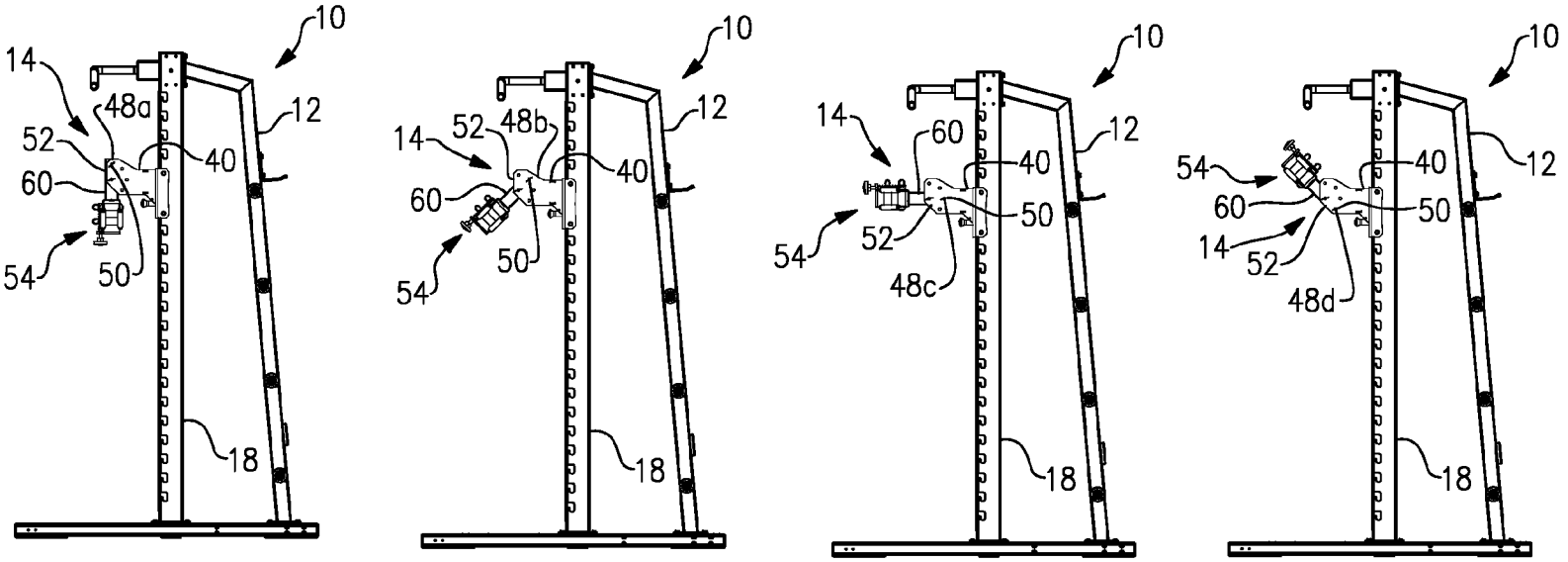
FIG. 8 is a side view of the rope pull assembly of FIG. 1 in the vertically aligned position.
FIG. 9 is a side view of the rope pull assembly of FIG. 1 in the first angled position.
FIG. 10 is a side view of the rope pull assembly of FIG. 1 in the horizontally aligned position.
FIG. 11 is a side view of the rope pull assembly of FIG. 1 in the second angled position.
Figure 14:
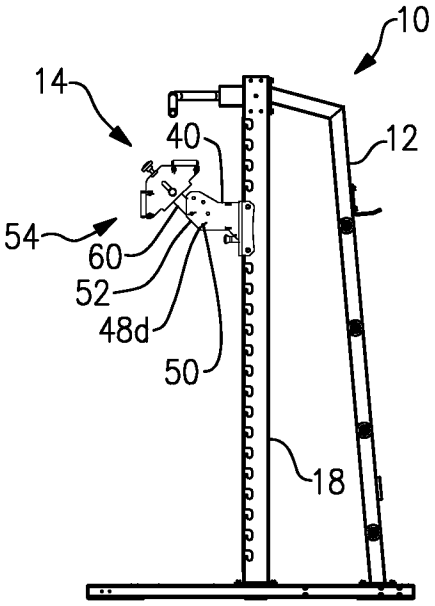
FIG. 14 is a side view of the rope pull assembly of FIG. 1 rotated relative to FIG. 11 and in the second angled position.
Figure 13:
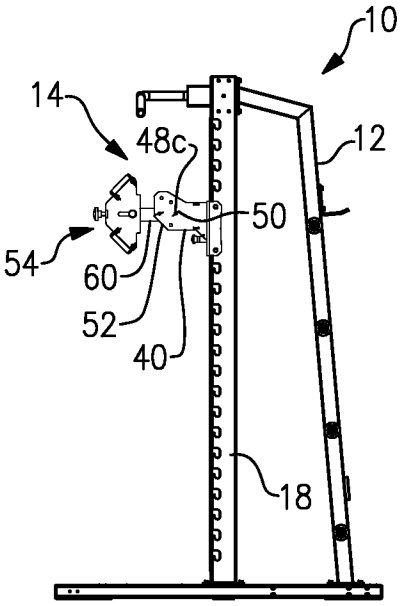
FIG. 13 is a side view of the rope pull assembly of FIG. 1 rotated relative to FIG. 10 and in the horizontal position.

FIG. 9 shows the support housing 54 secured in a first angled position. The support housing 54 is secured in the first angled position by pivoting the support housing 54 about the pivot pin 52 until the post pivot openings 63 on the post 60 align with the pair of adjustment openings 48*b* on the attachment support 40 to allow the support pin 50 to secure the support housing 54 in the first angled position.

FIG. 10 shows the support housing 54 secured in a horizontal position generally perpendicular to the upright frame member 18. The support housing 54 is secured in the horizontal position by pivoting the support housing 54 about the pivot pin 52 until the post pivot openings 63 on the post 60 align with the pair of adjustment openings 48*c* on the attachment support 40 to allow the support pin 50 to secure the support housing 54 in the horizontal position.

FIG. 11 shows the support housing 54 secured in a second angled position. The support housing 54 is secured in the second angled position by pivoting the support housing 54 about the pivot pin 52 until the post pivot openings 63 on the post 60 align with the pair of adjustment openings 48*d* on the attachment support 40 to allow the support pin 50 to secure the support housing 54 in the second angled position.

Figure 12:
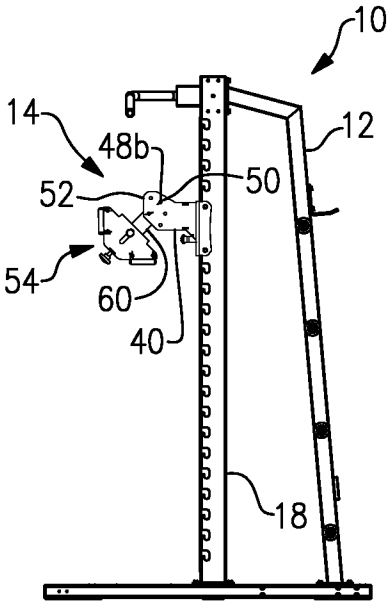
FIG. 12 is a side view of the rope pull assembly of FIG. 1 rotated relative to FIG. 9 and in the first angled position.

FIG. 12 shows the support housing 54 rotated 90 degrees and secured in the first angled position, horizontal position, and second angled positions, respectively. The pivot pin 52 and support pin 50 engage pivot post openings 63 on other sides of the post 60 when rotated 90 degrees.

Figure 15:
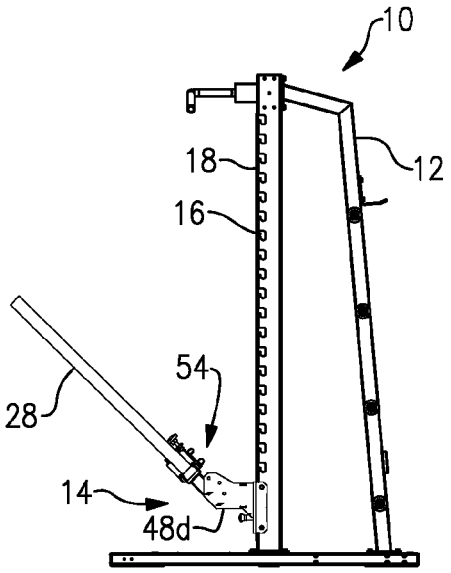
FIG. 15 is a side view of the rope pull assembly of FIG. 1 in the second angled position, including a rope, and lowered relative to the vertical position of the rope pull assembly of FIGS. 8-14.

Referring to FIG. 15, the rope pull assembly 14 is movable to different vertical positions along the upright frame member 18. Additionally, the upright frame member 18 could be attached directly to a wall 84 or another fixed element.

Figure 16:
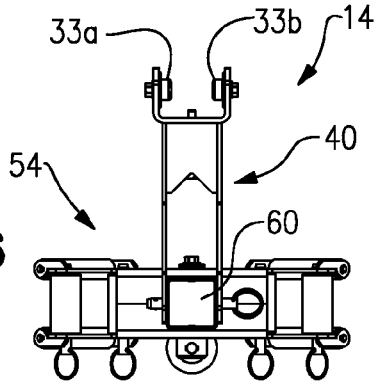
FIG. 16 is a top view of the rope pull assembly of FIG. 1.
Figure 17:
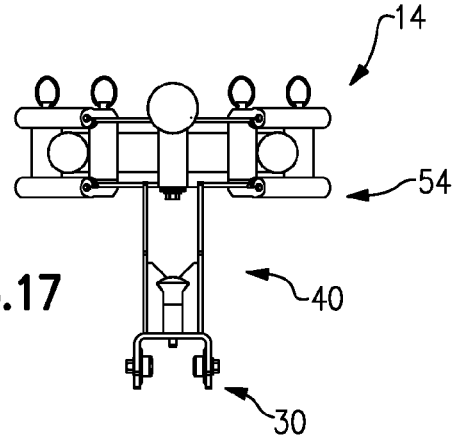
FIG. 17 is a bottom view of the rope pull assembly of FIG. 1.

Referring to FIGS. 16 and 17, the first housing member 56 and the first attachment plate 42 have been removed to illustrate an example interior of the rope pull assembly 14 when in the position of FIGS. 4-7.

Figure 18:
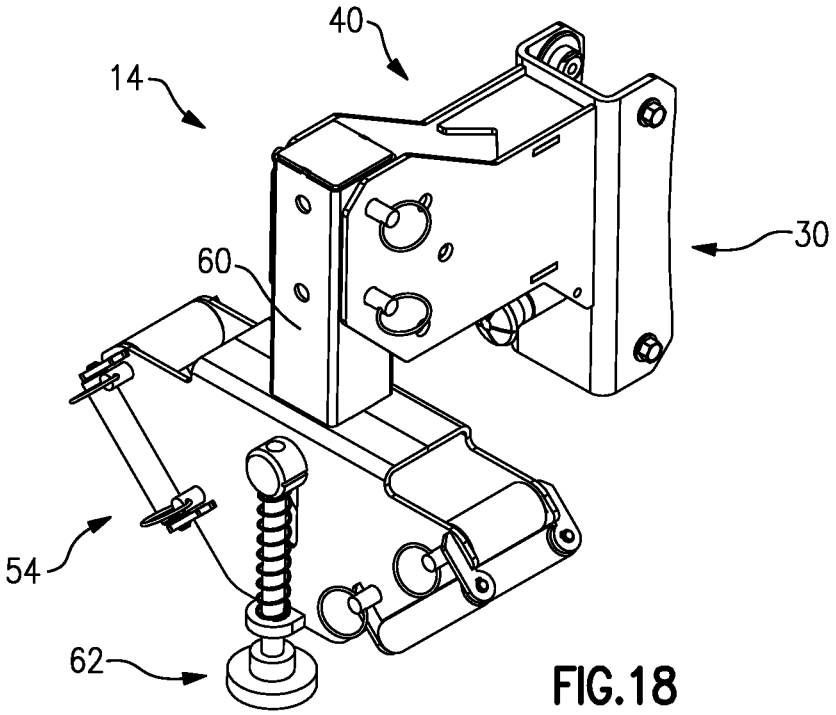
FIG. 18 is a general perspective view of the rope pull assembly of FIG. 1.
Figure 19:
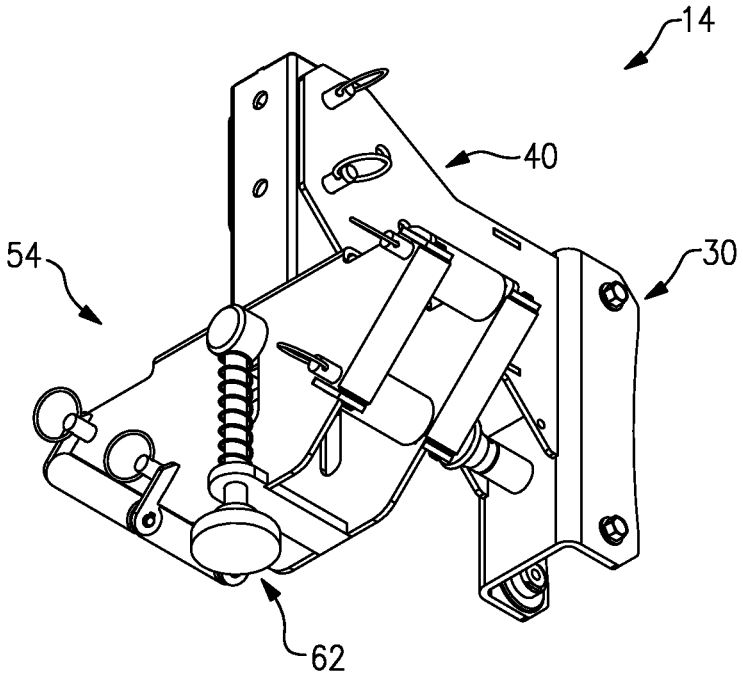
FIG. 19 is a general perspective view of the rope pull assembly of FIG. 1.
Figure 20:
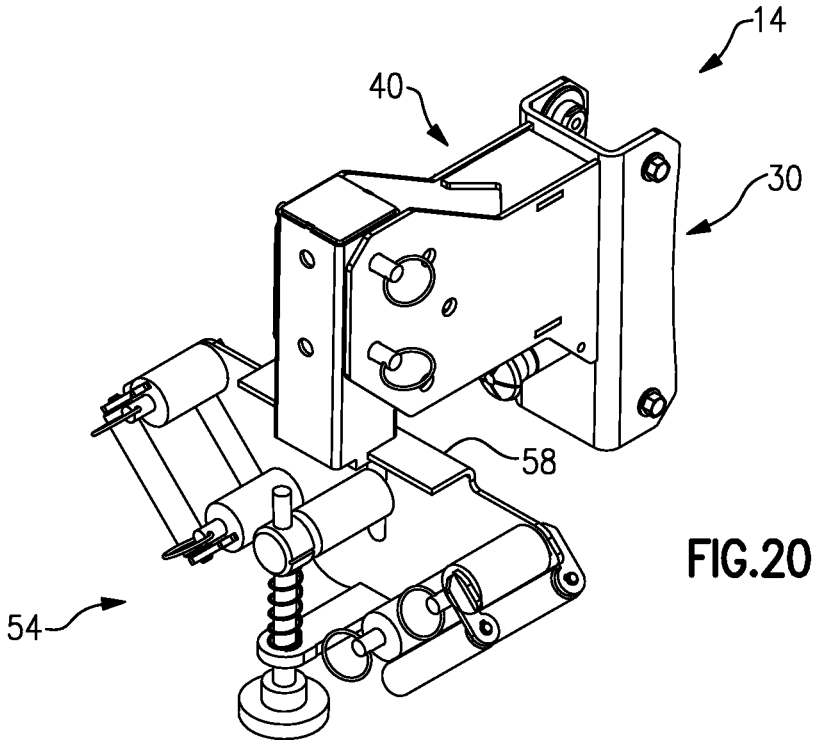
FIG. 20 is a general perspective view of the rope pull assembly of FIG. 1 with the first housing member and rope removed.
Figure 21:
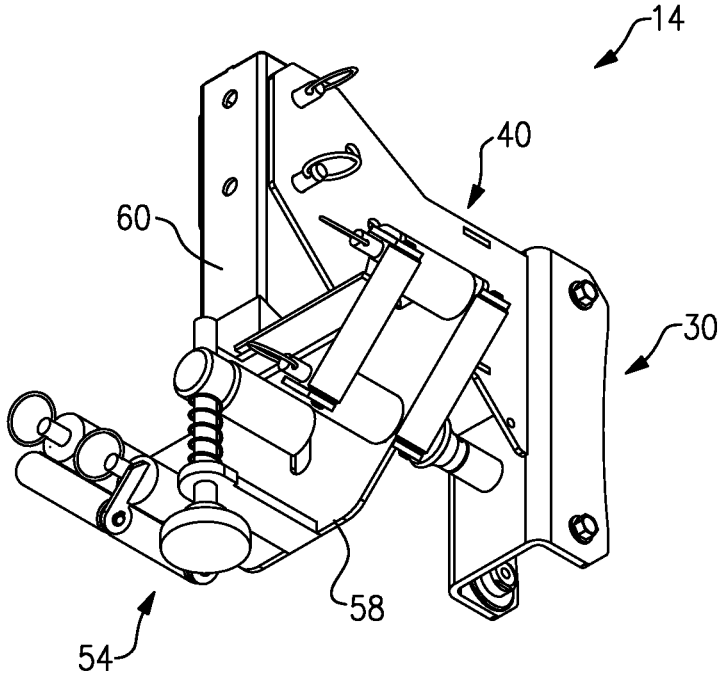
FIG. 21 is a general perspective view of the rope pull assembly of FIG. 1 with the first housing member and rope removed.

FIGS. 18 and 19 show additional perspective views of the rope pull assembly 14 with the rope 28 removed.

Although an example embodiment of this disclosure has been disclosed, a worker of ordinary skill in this art would recognize that certain modifications would come within the scope of this disclosure. For that reason, the following claims should be studied to determine the true scope and content of this disclosure.

We claim:

1. A resistive pull exercise device, comprising:

a support housing having an interior space, a first passageway and a second passageway each extending to the interior space;

at least one first roller at least partially defining a perimeter of the first passageway;

at least one second roller at least partially defining a perimeter of the second passageway; and a tension member moveable between a first position extending along a first axis to selectively impart a first resistive force to a length of material spanning the first passageway and the second passageway and a second position extending along a second axis spaced from the first axis to impart a second resistive force to the length of material different from the first resistive force, the first and second passageways spaced on opposing sides of the tension member, the length of material having a first surface section facing the tension member and a second surface section facing away from the tension member, the tension member configured to move the first surface section and the second surface section in a common direction when the tension member moves from the first position to the second position.

2. The resistive pull exercise device of claim 1, wherein the tension member extends through a first slot provided by a first sidewall of the support housing and a second slot provided by a second sidewall of the support housing, wherein the first slot and the second slot are positioned in the sidewalls such that the tension member is held between the first passageway and the second passageway.

3. The resistive pull exercise device of claim 1, wherein the tension member is configured to move from the first position to the second position to increase a curvature of the length of material to increase the resistive force, and further configured to move from the second position to the first position to decrease the curvature of the length of material, the curvature in the first position and the curvature in the second position extending from the first passageway to the second passageway.

4. The resistive pull exercise device of claim 1, wherein the tension member includes a roller configured to contact the first surface section of the length of material.

5. The resistive pull exercise device of claim 1, wherein the at least one first roller includes a first pair of rollers independently rotatable and spaced from each other and to define opposing sides of the perimeter of the first passageway, and the at least one second roller includes a second pair of rollers independently rotatable and spaced from each other to define opposing sides of the perimeter of the second passageway.

6. The resistive pull exercise device of claim 1, wherein the support housing is configured to pivot together relative to a fixed structure between a first position fixed from movement relative to the fixed structure and a second position fixed from movement relative to the fixed structure.

7. The resistive pull exercise device of claim 1, wherein when the tension member is in the first position a portion of the length of material includes a first curvature and when the tension member is in the second position the portion of the length of material includes a second curvature greater than the first curvature, the first curvature and the second curvature extending from the first passageway to the second passageway.

8. The resistive pull exercise device of claim 1, wherein the length of the material is configured to extend through the support housing along a serpentine path.

9. The resistive pull exercise device of claim 1, wherein the length of material comprises at least one of a rope or a belt.

10. The resistive pull exercise device of claim 1, wherein the length of material is a continuous loop.

11. An exercise system having the resistive pull exercise device of claim 1, further comprising a frame rack having an upright member to receive a main support of the resistive pull device, the support housing attached to the main support.

12. The exercise system of claim 11, wherein the support housing is attached to the main support about a pivotable connection and includes a pin to lock the support housing in a first portion or a second position.

13. A method of resisting movement of a length of material in a resistive pull device comprising:

guiding a length of material through a first passageway having a perimeter defined by at least one first roller that provides a side of a first passageway to an interior space of a support housing, and through a second passageway having a perimeter defined by at least one second roller that provides a side of an opposing, second passageway to the interior space;

increasing a curvature of the length of material to increase the resistive force by moving a tension member from a first position to a second position to move the length of material away from an axis extending through the first passageway and the second passageway; and decreasing the curvature of the length of material to decrease the resistive force by moving the tension member from the second position to the first position to permit movement of the length of material back toward the axis extending through the first passageway and the second passageway.

14. A resistive pull exercise device, comprising:

a first plate;

a second plate spaced from the first plate to define an interior space therebetween;

a plurality of first rollers, wherein a first passageway from outside the interior space to the interior space extends between one of the plurality of first rollers mounted to the first plate and one of the plurality of first rollers mounted to the second plate;

a plurality of second rollers, wherein a second passageway from outside the interior space to the interior space extends between one of the plurality of second rollers mounted to the first plate and one of the plurality of second rollers mounted to the second plate;

a length of material having a portion extending through the interior space from the first passageway to the second passageway; and a tension member adjustably mounted to at least one of the first and second plate and contacting the portion of the length of material to move the portion away from an axis extending through the first passageway and the second passageway.

15. The resistive pull exercise device of claim 14, wherein the tension member is movable in a direction transverse to the axis back and forth between a first position and a second position.

16. The resistive pull exercise device of claim 15, wherein when the tension member is in the first position a portion of the length of material includes a first curvature and when the tension member is in the second position the portion of the length of material includes a second curvature greater than the first curvature, the first curvature and the second curvature extending from the plurality of first rollers to the plurality of second rollers.

17. The method of claim 13, comprising translating the tension member relative to the support housing between the first position and the second position.

18. The resistive pull exercise device of claim 1, wherein a passageway axis extends through the first passageway and the second passageway, wherein the common direction is transverse to the passageway axis.

19. The resistive pull exercise device of claim 5, wherein the tension member directly contacts the length of material, and the tension member is separate and distinct from the at least one first roller and the at least one second roller.

20. The resistive pull exercise device of claim 1, wherein the tension member directly contacts the length of material and is fixed when imparting the first and second resistive forces such that the tension member does not rotate when imparting the first and second resistive forces to the length of material.

21. The method of claim 13, wherein a passageway axis extends through the first passageway and the second passageway, wherein the tension member moves between the first position and the second position in a direction that is transverse to the passageway axis.

22. The method of claim 13, wherein the length of material has an outer surface with a first section of the outer surface facing the tension member and a second section of the outer surface facing away from the tension member, the tension member configured to move the first surface and the second surface in a common direction during the increasing.

* * * * *